United States Patent [19]

Griffin

[11] 4,112,606

[45] Sep. 12, 1978

[54] MUZZLE LOADING DEVICE

[76] Inventor: William Griffin, 224 N. Sunset Terr., Jackson, Miss. 39212

[21] Appl. No.: 796,053

[22] Filed: May 12, 1977

[51] Int. Cl.[2] ..... F41C 27/00

[52] U.S. Cl. ..... 42/90

[58] Field of Search ..... 42/90, 1 R, 51, 87, 42/88

[56] References Cited

U.S. PATENT DOCUMENTS

| | | | |
|---|---|---|---|
| 243,250 | 6/1881 | Hall | 42/90 |
| 4,050,175 | 9/1977 | Mulinix | 42/90 |

OTHER PUBLICATIONS

"The American Rifleman," (Load-N-Cap Speed Loader), p. 42, Nov. 1976.

*Primary Examiner*—Charles T. Jordan

[57] ABSTRACT

A muzzle-loading device for carrying materials for muzzle-loading firearms includes a tubular body with one end adapted to hold a projectile and radially extending ears for holding percussion caps, an elongate container for holding powder having a closed end extending within the tubular body and graduations therealong for indicating the amount of powder in the container, and a cover extending over an open end of the container and removably secured to an end of the tubular body opposite the end holding the projectile to seal the open end of the container and hold the container in the body. The tubular body, the elongate container and the cover are preferably constructed of a resilient, transparent plastic material to permit viewing of the materials carried by the muzzle-loading device, and the elongate container has a bottom portion of reduced diameter adapted to be pushed through the tubular body to force the projectile into the muzzle of a firearm.

17 Claims, 3 Drawing Figures

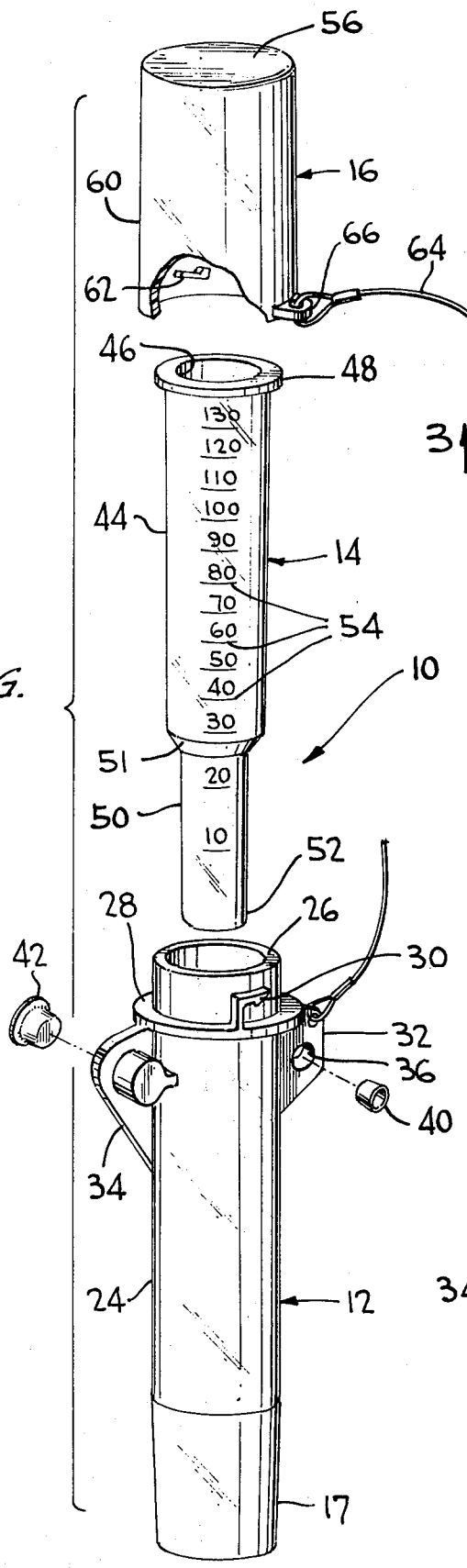
FIG. 1
FIG. 2
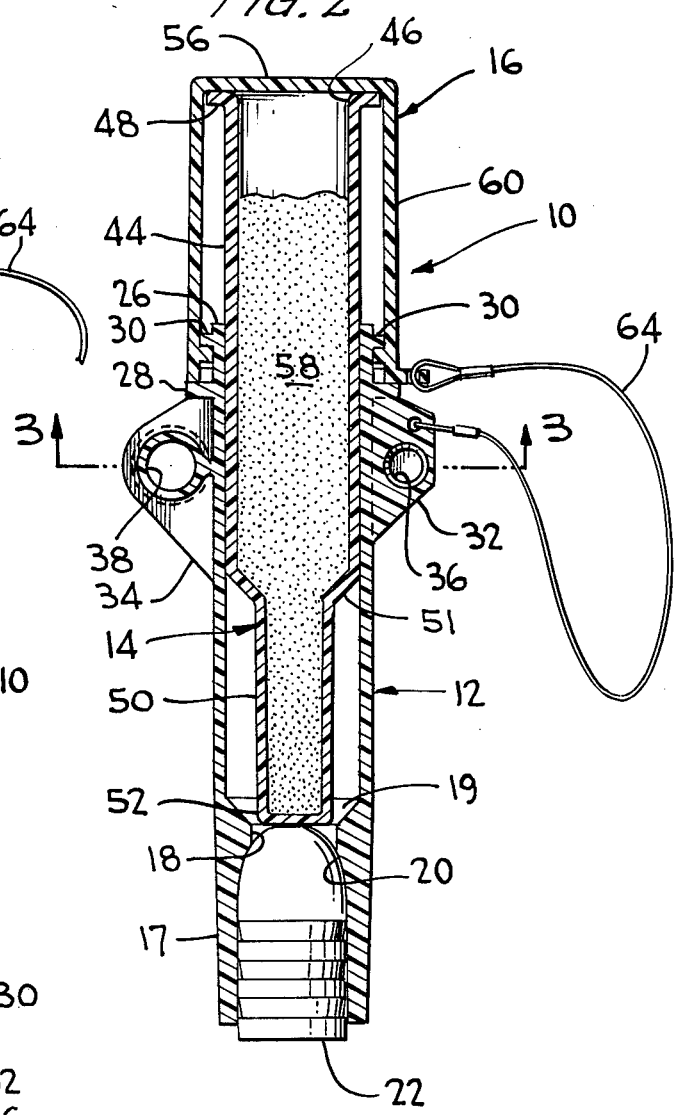
FIG. 3
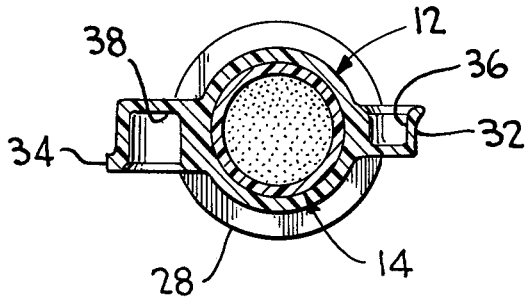

MUZZLE LOADING DEVICE

BACKGROUND OF THE INVENTION

1. Field of the Invention

The present invention pertains to the muzzle loading of firearms and, more particularly, to a muzzle-loading device for carrying projectiles, powder and percussion caps for expediting the muzzle loading of firearms, such as rifles.

2. Discussion of the Prior Art

Many people continue to muzzle-load firearms, such as rifles, due to the structure of the rifles as well as for their own enjoyment, even though great advances have been made in rifle loading technology. In order to muzzle-load a rifle, powder and a projectile, such as a bullet, must be loaded in the muzzle of the rifle, and a percussion cap must be placed on the nipple of the rifle. Thus, it is necessary for a person utilizing a muzzle-loading rifle to carry with him quantities of powder, bullets and percussion caps. While it is desirable to expedite the muzzle loading of such rifles, the procedures required to load the rifles cannot be automated without ruining the muzzle-loading concept.

In view of the above, it has been proposed to provide powder horns or storage pouches for the materials required for muzzle loading, as emplified in U.S. Pat. No. 3,775,889 to Wilburn; however, such devices are relatively complicated and expensive. Additionally, attempts have been made to provide muzzle loaders holding a charge of powder, a bullet and two percussion caps for use in muzzle-loading firearms, such as the Load-N-Cap Speed Loader Manufactured by Hole In The Wall of Richland, WA. Such muzzle loaders have been formed basically of a partitioned brass tube adapted to hold powder in one compartment and a projectile in the other compartment with end caps for the compartments holding percussion caps. These muzzle loaders suffer the disadvantages of being relatively heavy, of loosely carrying bullets which cause noise due to the metal-to-metal contact of carrying only a single type of percussion cap and of not facilitating the carrying of a measured amount of powder charge to permit precise loading of a rifle. Another disadvantage of prior art muzzle loaders is that they require the projectile to be placed in the muzzle of a firearm by hand.

SUMMARY OF THE INVENTION

Accordingly, it is an object of the present invention to provide a muzzle-loading device for carrying materials for muzzle-loading firearms overcoming the above-mentioned disadvantages of the prior art.

An additional object of the present invention is to construct a muzzle-loading device of a tubular body having an end for holding a projectile with a friction fit, an elongate container inserted within the body having graduations thereon for loading a precisely determined amount of powder, and a cover extending over a protruding portion of the elongate container to seal an open end thereof when the cover is secured to the body.

A further object of the present invention is to hold percussion caps in radially extending ears of a tubular body frictionally holding a projectile in one end and having an elongate container for powder inserted in the other end.

The present invention has a further object in that a muzzle-loading device is formed of transparent, resilient plastic material to permit viewing of the contents of the device, the device including an elongate container having graduations therealong for indicating the amount of powder to be used in charging a firearm.

Yet another object of the present invention is to utilize a cover member to seal an open end of an elongate container for powder as well as to hold the container within a tubular body of a muzzle-loading device.

Some of the advantages of the muzzle-loading device of the present invention over the prior art are that it is light in weight, is simple and inexpensive to manufacture, obviates the necessity of manually handling the projectile to start it into the muzzle of a firearm, permits viewing of the materials carried thereby and provides graduations to permit precise loading of a charge of powder.

The present invention is generally characterized in a muzzle-loading device for carrying materials for muzzle-loading firearms including a tubular body having a first end adapted to hold a projectile and a second end; an elongate container for holding powder having a closed end and an open end, the container having a portion including the closed end inserted in the tubular body; and a cover extending over the open end of the container and removably secured to the second end of the body to seal the open end of the container and hold the container in the body.

Other objects and advantages of the present invention will become more apparent from the following description of the preferred embodiment taken in conjunction with the accompanying drawings.

BRIEF DESCRIPTION OF THE DRAWINGS

FIG. 1 is an exploded view of a muzzle-loading device according to the present invention.

FIG. 2 is an elevation of the muzzle-loading device of the present invention in section.

FIG. 3 is a section of the muzzle-loading device of the present invention taken along line 3—3 of FIG. 2.

DESCRIPTION OF THE PREFERRED EMBODIMENT

A muzzle-loading device 10 according to the present invention, as illustrated in FIGS. 1, 2 and 3, is formed of a tubular body 12, an elongate container 14 and a cover 16 as basic components. The tubular body 12 has a tapered lower end 17 with a wall having a passage 18 therethrough extending from an upper internal shoulder 19 to a lower curved surface 20, the wall defining a chamber for holding a projectile, such as a bullet 22, therein with the curved surface 20 acting as a stop to limit insertion of the bullet. The tubular body 12 has a cylindrical wall 24 terminating at an upper open end 26, and a flange 28 extends radially outwardly from a portion of the wall 24 adjacent the open end 26 and carries locking lugs 30. Diametrically opposed ears 32 and 34 extend radially from wall 24 adjacent the open end 26 and have recesses 36 and 38 therein for receiving various size percussion caps 40 and 42, respectively.

The elongate container 14 has a top cylindrical portion 44 terminating at an open end 46 having a sealing flange 48 extending radially therefrom, and the top portion 44 joins a bottom portion 50 having a diameter less than the diameter of the top portion via an external shoulder 51, the bottom portion 50 terminating at a closed end 52 adapted to abut the end of the projectile 22 held in the end 18 of the tubular body 12. The diameter of the bottom portion 50 is less than the diameter of passage 18 in the body 12 to permit the bottom portion to extend therethrough, and the length of bottom portion 50 is at least ⅛ inch longer than the distance from passage 18 to the lip of lower end 17 of the body 12 to permit the bullet 22 to be initially started into the muzzle of a firearm as will be described hereinafter. The elongate container 14 carries graduations 54 therealong in increments of 10 grains from 10 to 140 grains to provide an indication of the amount of powder held in the container and thereby eliminate the necessity of carrying a separate powder measure.

The cover 16 has a top wall 56 adapted to seat against flange 48 at the open end 46 of the elongate container to seal powder 58 within the container and a cylindrical skirt 60 depending from the top wall and carrying internal lugs 62 for engaging the lugs 30 on body 12 to permit the cover to be secured to the body by rotation relative thereto. The cover 16 is tethered to the body 12 by means of flexible loop 64 attached to an ear 66 extending from the cover 16 and to percussion cap holding ear 32.

The body 12, container 14 and cover 16 of the muzzle-loading device 10 are preferably integrally constructed of a resilient, transparent plastic material to permit viewing of the materials carried by the muzzle-loading device. The resilient nature of the plastic material permits projectiles to be firmly held in end 17 of the body 12 with a friction fit without fear of accidental dislodgment of the projectile and, similarly, permits the percussion caps 40 and 42 to be firmly held in the recesses 36 and 38 in ears 32 and 34.

In use, a projectile, such as bullet 22, to be carried by the muzzle-loading device 10 is lubricated and placed base down on a hard flat surface, and the open end 17 of the body 12 is pressed downward over the bullet until the nose of the bullet engages stop 20, the resilient material of the body flexing to securely grasp the bullet with a friction fit. The container 14 is inserted into the upper chamber of the body 12 defined by open end 26 until its closed end 52 contacts the nose of the bullet, and the container is filled with a predetermined amount or charge of powder as determined by the graduations 54. The cover 60 is now placed over the protruding portion of the container 14 to provide a seal with the flange 48, and the cover is rotated relative to the body such that the locking lugs 30 and 62 engage to hold the cover in position secured to the body. The friction fit of the bullet 22 provides ample resistance to prevent the container from moving within the body.

For muzzle-loading a rifle, the bullet and percussion caps are easily removed from the body without requiring the removal of caps or other covers, and the cover 60 can be removed from the body by rotation to disengage the locking lugs, it being appreciated that the seal effected by top wall 56 of the cover and flange 48 of the container retains the powder 58 in a dry and clean condition. Once the powder has been inserted in the muzzle of a firearm, the protruding base of the bullet 22 can be inserted in the open end of the muzzle bore while still held in the body 12 to serve as an indexing means for aligning the end 17 of the body with the muzzle bore. The bullet is now in position to be inserted into the muzzle, and such insertion can be easily accomplished without touching the bullet by striking the flange 48 of container 14 sharply with the palm or heel of the hand to force the bottom portion 50 of the container through passage 18 until external shoulder 51 abuts internal shoulder 19. As set forth above, the length of the bottom portion 50 of container is at least ⅛ inch longer than the distance between passage 18 and the lip of end 17 of the body; and, thus, the bottom portion 50 is utilized as a ram to insert the bullet 22 into the bore of the barrel of the firearm to a minimum distance of ⅛ inch below the muzzle thereby providing a lead-in for use of a ram rod.

From the above, it will be appreciated that the muzzle-loading device of the present invention provides the functions of both carrying all of the materials required to muzzle-load a firearm and initially starting or inserting a projectile in the muzzle of a firearm without requiring handling of the projectile.

Inasmuch as the present invention is subject to many variations, modifications and changes in detail, it is intended that all subject matter discussed above or shown in the accompanying drawings be interpreted as illustrative and not in a limiting sense.

What is claimed is:

1. A muzzle-loading device for carrying materials for muzzle-loading firearms comprising a tubular body having a first end adapted to hold a projectile and a second end;

an elongate container for holding powder having a closed end and an open end, said container having a portion including said closed end inserted in said tubular body; and a cover extending over said open end of said container and removably secured to said second end of said body to seal said open end of said container and hold said container in said body.

2. A muzzle-loading device for carrying materials for muzzle-loading firearms as recited in claim 1 wherein said elongate container has graduations for indicating the amount of powder in said container.

3. A muzzle-loading device for carrying materials for muzzle-loading firearms as recited in claim 2 wherein said first end of said body, has a passage therethrough and said elongate container has a top portion terminating at said open end and a bottom portion terminating at said closed end and having a diameter less than the diameter of said top portion and said passage to permit said container to be used as a ram to insert a projectile in the muzzle of a firearm.

4. A muzzle-loading device for carrying materials for muzzle-loading firearms as recited in claim 3 and further comprising means carried on said body for holding percussion caps.

5. A muzzle-loading device for carrying materials for muzzle-loading firearms as recited in claim 4 wherein said percussion cap holding means includes ears extending radially from said body adjacent said second end, said ears having recesses for receiving percussion caps and being integrally formed with said body.

6. A muzzle-loading device for carrying materials for muzzle-loading firearms as recited in claim 5 wherein said body carries first lug means adjacent said second end and said cover carries second lug means engaging said first lug means to secure said cover to said body, said cover being rotatable relative to said body to engage and disengage said first and second lug means to permit securing and removal of said cover.

7. A muzzle-loading device for carrying materials for muzzle-loading firearms as recited in claim 6 wherein said cover is tethered to said body.

8. A muzzle-loading device for carrying materials for muzzle-loading firearms as recited in claim 7 wherein said body has a curved inner wall terminating at said passage through said first end to act as a stop against the curved nose of a projectile.

9. A muzzle-loading device for carrying materials for muzzle-loading firearms as recited in claim 8 wherein said body, said container and said cover are made of a resilient, plastic material.

10. A muzzle-loading device for carrying materials for muzzle-loading firearms as recited in claim 9 wherein said plastic material is transparent.

11. A muzzle-loading device for carrying materials for muzzle-loading firearms as recited in claim 1 wherein said body carries first lug means adjacent said second end and said cover carries second lug means engaging said first lug means to secure said cover to said body, said cover being rotatable relative to said body to engage and disengage said first and second lug means to permit securing and removal of said cover.

12. A muzzle-loading device for carrying materials for muzzle-loading firearms as recited in claim 2 wherein said container is made of a transparent material to permit viewing of the amount of powder in said container.

13. A muzzle-loading device for carrying materials for muzzle-loading firearms as recited in claim 1 wherein said body is made of a resilient plastic material to hold the projectile with a friction fit.

14. A method for loading a muzzle-loading firearm which comprises placing a projectile to be loaded into the bore of a muzzle-loading firearm onto a hard flat surface, said projectile having a nose end, and a rear end;

pressing over the nose end of the projectile an open end of a tubular body, said open end being adapted to hold said projectile with said nose end thereof interiorly of said tubular body, said tubular body having a second open end adapted to receive an elongate container for holding powder, said elongate container having one open end and one closed end and having graduations thereon;

inserting the container into said second open end of said tubular body until said closed end thereof contacts said nose end of said projectile;

filling said container with a predetermined amount of powder as determined by said graduations;

covering said open end of said container to provide a seal for the powder contained therein until said powder is to be placed into the bore of a rifle, whereupon said open end is uncovered and said powder is poured into the bore of the rifle;

placing said tubular body adjacent the bore of the rifle being loaded such that the rear end of said projectile overlies the bore;

pressing said container further into said tubular body to force said closed end of said container against said nose end of said projectile, thereby ramming said projectile into the bore of the rifle a predetermined minimum distance to provide a lead-in for use of a ram rod; and ramming said projectile further into the bore with a ram rod.

15. A muzzle-loading device for carrying materials for muzzle-loading firearms comprising a tubular body having a first open end defining a first chamber adapter to hold a projectile, a second open end defining a second chamber and means separating said first and second chambers and having a passage therethrough; and an elongate container for holding powder having a portion terminating at a closed end positioned in said second chamber of said body, said portion of said container having a diameter less than the diameter of said passage in said body whereby a projectile can be initially inserted in the muzzle of a firearm without handling the projectile by indexing said body adjacent the muzzle and forcing the projectile into the muzzle by striking said container to force said portion of said container through said passage with said closed end engaging the projectile.

16. A muzzle-loading device for carrying materials for muzzle-loading firearms according to claim 15 wherein said separating means in said body has a lower curved surface to act as a stop against the curved nose of a projectile.

17. A muzzle-loading device for carrying materials for muzzle-loading firearms according to claim 16 wherein said separating means has an upper surface defining an internal shoulder and said container has an external shoulder extending from said portion to limit movement of said portion through said passage by abutment with said internal shoulder.

* * * * *